US010739801B2

(12) United States Patent
Tang

(10) Patent No.: US 10,739,801 B2
(45) Date of Patent: Aug. 11, 2020

(54) BAND-GAP REFERENCE CIRCUIT

(71) Applicant: Wuhan Xinxin Semiconductor Manufacturing Co., Ltd., Wuhan, Hubei (CN)

(72) Inventor: Yuan Tang, San Jose, CA (US)

(73) Assignee: WUHAN XINXIN SEMICONDUCTOR MANUFACTURING CO., LD., Wuhan, Hubei (CN)

( * ) Notice: Subject to any disclaimer, the term of this patent is extended or adjusted under 35 U.S.C. 154(b) by 5 days.

(21) Appl. No.: 16/212,234

(22) Filed: Dec. 6, 2018

(65) Prior Publication Data

US 2019/0235547 A1 Aug. 1, 2019

(30) Foreign Application Priority Data

Jan. 26, 2018 (CN) ..... 2018 1 0078008

(51) Int. Cl.
*G05F 1/575* (2006.01)
*G05F 3/30* (2006.01)
*G05F 1/46* (2006.01)

(52) U.S. Cl.
CPC ..... *G05F 1/575* (2013.01); *G05F 1/468* (2013.01); *G05F 3/30* (2013.01)

(58) Field of Classification Search
CPC ... G05F 1/56; G05F 1/565; G05F 3/10; G05F 3/16; G05F 3/20; G05F 3/205; G05F 3/24; G05F 3/247; G05F 3/26; G05F 3/262
See application file for complete search history.

(56) References Cited

U.S. PATENT DOCUMENTS 5,625,278 A * 4/1997 Thiel ..... G05F 1/575 323/274
7,495,505 B2 * 2/2009 Chang ..... G05F 3/30 323/313
7,834,610 B2 * 11/2010 Peng ..... G05F 3/30 323/313

(Continued)

FOREIGN PATENT DOCUMENTS

CN 102681584 A 9/2012
CN 103440009 A 12/2013

(Continued)

OTHER PUBLICATIONS

Translation of CN-102681584-B (Year: 2014).*

*Primary Examiner* — Gary L Laxton
(74) *Attorney, Agent, or Firm* — Muncy, Geissler, Olds & Lowe, P.C.

(57) ABSTRACT

A band-gap reference circuit including a low drop-out (LDO) regulator and a reference circuit is disclosed. The LDO regulator outputs a regulating voltage which is provided to the reference circuit, and wherein the regulating voltage is maintained constant and powers the reference circuit such that the reference circuit outputs a band-gap reference voltage. According to the reference circuitry, the LDO regulator can output a stable voltage such that the regulating voltage can be maintained constant, therefore, causing the band-gap reference voltage output from the reference circuit to be maintained constant, hence improving the reliability of the band-gap reference voltage.

10 Claims, 2 Drawing Sheets

(56) References Cited

U.S. PATENT DOCUMENTS

| | | | | |
|---|---|---|---|---|
| 2011/0175593 | A1* | 7/2011 | Ookuma | G05F 3/30 323/313 |
| 2013/0033245 | A1* | 2/2013 | Wong | G05F 3/30 323/281 |
| 2014/0340068 | A1* | 11/2014 | Lin | G05F 3/26 323/313 |
| 2015/0130434 | A1 | 5/2015 | Jain et al. | |
| 2015/0286236 | A1* | 10/2015 | Dornseifer | G05F 3/08 323/313 |
| 2016/0252919 | A1 | 9/2016 | Tanaka | |

FOREIGN PATENT DOCUMENTS

| | | | | |
|---|---|---|---|---|
| CN | 102681584 | B | * | 4/2014 |
| CN | 106940580 | A | | 7/2017 |

* cited by examiner

BAND-GAP REFERENCE CIRCUIT

CROSS-REFERENCE TO RELATED APPLICATION

This application claims the priority of Chinese patent application number 201810078008.8, filed on Jan. 26, 2018, the entire contents of which are incorporated herein by reference.

TECHNICAL FIELD

The present invention relates to the field of semiconductor technology and, in particular, to a band-gap reference circuit.

BACKGROUND

A wide range of analog circuits are provided with voltage or current references in the form of DC quantities. Such DC quantities depend barely on power supply or process parameters, but usually have a predefined relationship with temperature. Such references are created in order to produce a DC voltage or current that is independent from power supply or process parameters but is associated a predetermined temperature characteristic. In most applications, the desired temperature characteristic may be: 1) proportional to absolute temperature (PTAT), 2) a constant Gm characteristic, i.e. a transconductance (Gm) constant of some transistors; or 3) independent from temperature. To implement a source of a reference voltage source, concerns are mainly involved in the control over temperature and power supply in order to achieve a predetermined relationship to temperature and a substantial independence from the power supply. As semiconductors almost have no temperature-independent parameters, the independence from temperature has to be achieved by appropriate combinations of selected power-independent parameters with positive and negative temperature coefficients. Moreover, these selected parameters shall be independent from the power supply. A band-gap of a semiconductor is defined as the difference between the bottom of its conduction band and the top of its valence band. A band-gap voltage reference (also briefly known as band-gap) provides a temperature-independent voltage reference generated from a sum of a voltage proportional to temperature and a voltage drop across a diode, with temperature coefficients of them cancelling out. As this voltage reference is comparable to the band-gap voltage of silicon, it is also known as band-gap reference. Some conventional band-gap architectures may also adopt an output voltage different from the above band-gap voltage.

It is noted that in existing band-gap reference circuits, a relatively low power supply voltage may result in an inaccurate output voltage of the band-gap reference circuit.

SUMMARY OF THE INVENTION

It is an object of the present invention to provide a band-gap reference circuit so as to solve the powering problem of an existing band-gap reference circuit.

To this end, the invention provides a band-gap reference circuit comprising a low drop-out (LDO) regulator and a reference circuit. The LDO regulator outputs a regulating voltage and provides the regulating voltage to the reference circuit, and wherein the regulating voltage is maintained constant and powers the reference circuit such that the reference circuit outputs a band-gap reference voltage.

Optionally, in the band-gap reference circuit, the LDO regulator may be powered by a supply voltage ranging from 1.6 V to 3.8 V.

Optionally, in the band-gap reference circuit, the regulating voltage may be 1.6 V and the band-gap reference voltage may be 1.2 V.

Optionally, in the band-gap reference circuit, the LDO regulator may comprise a first operational amplifier, a first transistor and a voltage feedback circuit, wherein: the first transistor is coupled between the supply voltage and the regulating voltage; the first operational amplifier outputs a first gate control voltage to switch on or switch off the first transistor; the voltage feedback circuit provides a feedback voltage which is positively correlated with the first gate control voltage to the first operational amplifier; and the first transistor is implemented as a P-channel field-effect transistor.

Optionally, in the band-gap reference circuit, the band-gap reference voltage is coupled to an inverting input of the first operational amplifier and the feedback voltage is coupled to a non-inverting input of the first operational amplifier, wherein a gate of the first transistor is connected to an output of the first operational amplifier, a source of the first transistor is coupled to the supply voltage and a drain of the first transistor is connected to the voltage feedback circuit and coupled to the regulating voltage, and wherein the voltage feedback circuit comprises a first resistor and a second resistor, the first resistor connected to the drain of the first transistor at one end and to the non-inverting input of the first operational amplifier at the other end, the second resistor grounded at one end and connected to the non-inverting input of the first operational amplifier at the other end.

Optionally, in the band-gap reference circuit, the reference circuit may comprise a second transistor and a third transistor with each of the second and third transistors being implemented as a P-channel field-effect transistor, wherein a source of the second transistor and a source of the third transistor are connected to the regulating voltage, and wherein a gate of the second transistor and a gate of the third transistor are connected to each other.

Optionally, in the band-gap reference circuit, the reference circuit may further comprise a second operational amplifier and wherein an output of the second operational amplifier is connected to the gates of the second and third transistors; an inverting input of the second operational amplifier is connected to a drain of the second transistor; and a non-inverting input of the second operational amplifier is connected to a drain of the third transistor; the band-gap reference voltage is output from a node between the non-inverting input of the second operational amplifier and the drain of the third transistor.

Optionally, in the band-gap reference circuit, the reference circuit may further comprise a fourth transistor and a fifth transistor with each of the fourth and fifth transistors being implemented as a PNP triode, and wherein an emitter of the fourth transistor is coupled to the inverting input of the second operational amplifier, an emitter of the fifth transistor is coupled to the non-inverting input of the second operational amplifier, a collector and a base of the fourth transistor are both grounded, and a collector and a base of the fifth transistor are both grounded.

Optionally, in the band-gap reference circuit, the reference circuit may further comprise a third resistor, a fourth resistor and a fifth resistor, and wherein the third resistor is connected to the inverting input of the second operational amplifier at one end and the third resistor is connected to the emitter of the fourth transistor at the other end, the fourth resistor is connected to the non-inverting input of the second operational amplifier at one end and the fourth resistor is connected to one end of the fifth resistor at the other end, and the fifth resistor is connected to the emitter of the fifth transistor at the other end.

The invention further provides a band-gap reference circuit comprising a first operational amplifier, a second operational amplifier, first to third transistors and a voltage feedback circuit. Each of the first to third transistors is implemented as a P-channel field-effect transistor. a source of the first transistor is coupled to a supply voltage and a drain of the first transistor is connected to the voltage feedback circuit and coupled to a regulating voltage. The first operational amplifier outputs a first gate control voltage to a gate of the first transistor to switch on or switch off the first transistor. The voltage feedback circuit provides a feedback voltage which is positively correlated with the first gate control voltage to a non-inverting input of the first operational amplifier. A source of the second transistor and a source of the third transistor are connected to the regulating voltage. A gate of the second transistor and a gate of the third transistor are connected to each other and further connected to an output of the second operational amplifier. A drain of the second transistor is connected to an inverting input of the second operational amplifier, and a drain of the third transistor is connected to a non-inverting input of the second operational amplifier. A band-gap reference voltage is output from a node between the drain of the third transistor and the non-inverting input of the second operational amplifier, the band-gap reference voltage being applied to an inverting input of the first operational amplifier.

Optionally, the voltage feedback circuit comprises a first resistor and a second resistor. The first resistor is connected to the drain of the first transistor at one end and to the non-inverting input of the first operational amplifier at the other end. The second resistor is grounded at one end and connected to the non-inverting input of the first operational amplifier at the other end.

Optionally, the band-gap reference circuit further comprises a fourth transistor and a fifth transistor with each of the fourth and fifth transistors being implemented as a PNP triode. An emitter of the fourth transistor is coupled to the inverting input of the second operational amplifier. An emitter of the fifth transistor is coupled to the non-inverting input of the second operational amplifier. A collector and a base of the fourth transistor are both grounded, and a collector and a base of the fifth transistor are both grounded.

Optionally, the band-gap reference circuit further comprises a third resistor, a fourth resistor and a fifth resistor. The third resistor is connected to the inverting input of the second operational amplifier at one end and the third resistor is connected to the emitter of the fourth transistor at the other end. The fourth resistor is connected to the non-inverting input of the second operational amplifier at one end and the fourth resistor is connected to one end of the fifth resistor at the other end. The fifth resistor is connected to the emitter of the fifth transistor at the other end. The band-gap reference circuit is powered by a supply voltage ranging from 1.6 V to 3.8 V. The regulating voltage is 1.6 V and the band-gap reference voltage is 1.2 V.

Optionally, in the band-gap reference circuit, the non-inverting and inverting inputs of the second operational amplifier may be equal in level.

A band-gap reference circuit comprising a LDO regulator and a reference circuit is provided in the present invention; the LDO regulator 10 can output a stable voltage such that the regulating voltage can be maintained constant, therefore, causing the band-gap reference voltage output from the reference circuit to be maintained constant, hence improving the reliability of the band-gap reference voltage.

In these figures: 10, the LDO regulator; and 20, the reference circuit.

DETAILED DESCRIPTION

A band-gap reference circuit proposed in this invention will be described below in further detail with reference to the accompanying drawings and some specific embodiments. Features and advantages of the invention will be more apparent from the following detailed description, and from the appended claims. It is noted that the figures are provided in a very simplified form not necessarily presented to scale, with the only intention to facilitate convenience and clarity in explaining the embodiments of the invention.

The core concept of the present invention is to provide a band-gap reference circuit to solve the powering problem of an existing band-gap reference circuit.

To this end, the invention provides a band-gap reference circuit comprising a low drop-out (LDO) regulator and a reference circuit. The LDO regulator outputs a regulating voltage provided to the reference circuit, wherein the regulating voltage is constant and powers the reference circuit such that the reference circuit outputs a band-gap reference voltage.

Figure 1:
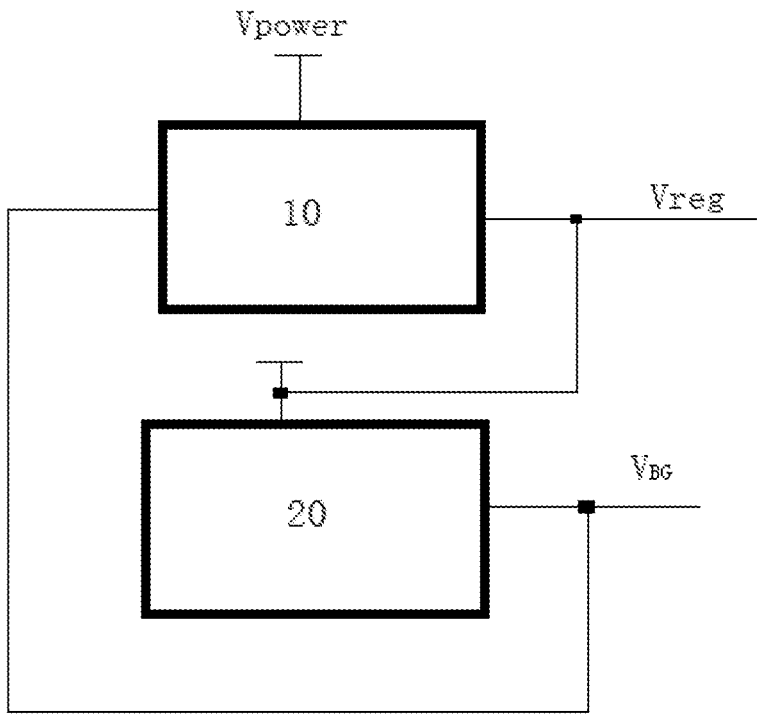
FIG. 1 schematically illustrates a band-gap reference circuit according to an embodiment of the present invention.
Figure 2:
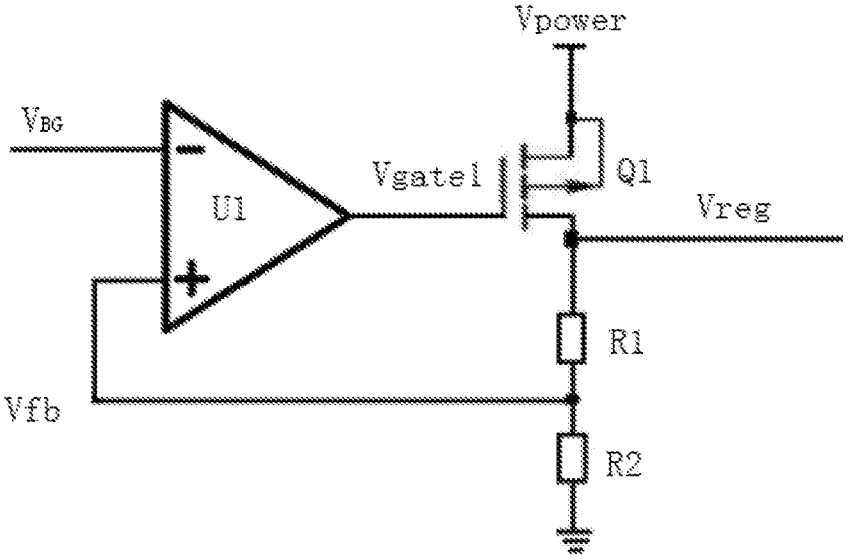
FIG. 2 schematically illustrates an LDO regulator in the band-gap reference circuit according to an embodiment of the present invention.

In the embodiment illustrated in FIG. 1, it provides a band-gap reference circuit. The band-gap reference circuit includes an LDO regulator 10 and a reference circuit 20. The LDO regulator 10 outputs a regulating voltage Vreg provided to the reference circuit 20, wherein the regulating voltage Vreg is constant and powers the reference circuit such that the reference circuit 20 outputs a band-gap reference voltage $V_{BG}$.

Specifically, in the band-gap reference circuit, the LDO regulator 10 may be powered by a supply voltage Vpower ranging from 1.6 V to 3.8 V. The regulating voltage Vreg may be 1.6 V and the band-gap reference voltage $V_{BG}$ may be 1.2 V. The band-gap reference voltage $V_{BG}$ only provides a voltage without providing any current. The reference circuit 20 is configured to provide the LDO regulator 10 and any other circuit in the chip with a reference voltage.

Additionally, in the band-gap reference circuit, the LDO regulator 10 may comprise a first operational amplifier U1, a first transistor Q1 and a voltage feedback circuit. The transistor Q1 is coupled between the supply voltage Vpower and the regulating voltage Vreg. The first operational amplifier U1 outputs a first gate control voltage Vgate1 configured to switch the first transistor Q1 on or off. The voltage feedback circuit provides the first operational amplifier U1 with a feedback voltage Vfb which is positively correlated with the first gate control voltage Vgate1. And the first transistor Q1 is implemented as a P-channel field-effect transistor. The first operational amplifier U1 may have an inverting input coupled to the band-gap reference voltage $V_{BG}$ which is looped back to the LDO regulator 10 as a reference voltage thereof. The first operational amplifier U1 may have a non-inverting input coupled to the feedback voltage Vfb. The first transistor Q1 may have a gate connected to an output of the first operational amplifier U1, a source coupled to the supply voltage Vpower and a drain connected to the voltage feedback circuit and coupled to the regulating voltage Vreg. The voltage feedback circuit may include a first resistor R1 and a second resistor R2. The first resistor R1 is connected to the drain of the first transistor Q1 at one end and to the non-inverting input of the first operational amplifier U1 at the other end. And the second resistor is grounded at one end and connected to the non-inverting input of the first operational amplifier U1 at the other end.

Figure 3:
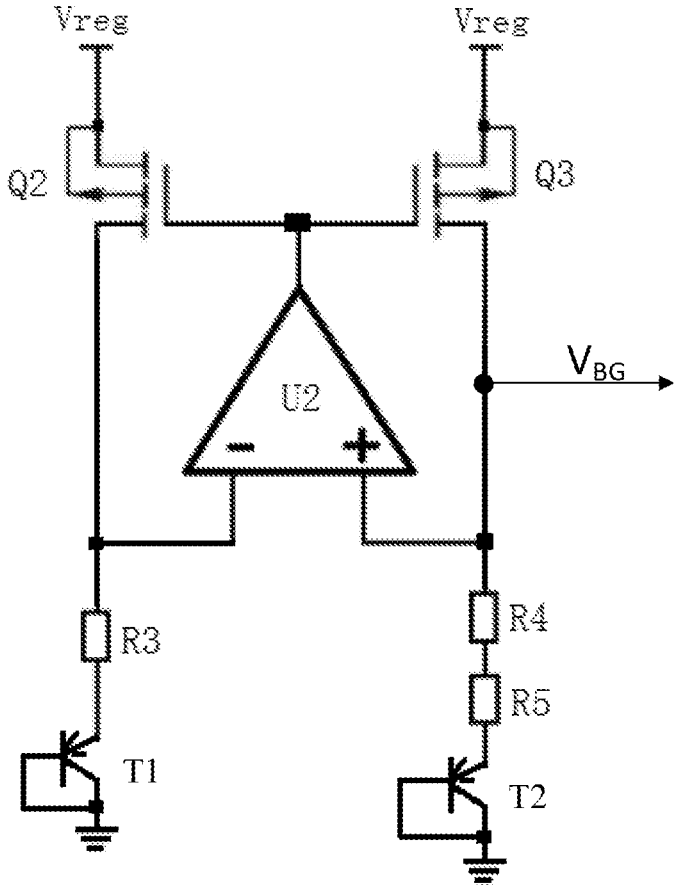
FIG. 3 schematically illustrates a reference circuit in the band-gap reference circuit according to an embodiment of the present invention.

As shown in FIG. 3, in the band-gap reference circuit, the reference circuit 20 may include a second operational amplifier U2, a second transistor Q2, a third transistor Q3, a fourth transistor T1, a fifth transistor T2, a third resistor R3, a fourth resistor R4 and a fifth resistor R5. The second transistor Q2 and the third transistor Q3 are both implemented as P-channel field-effect transistors. The fourth transistor T1 and the fifth transistor T2 are both implemented as PNP triodes. An output of the second operational amplifier U2 is connected both to a gate of the second transistor Q2 and to a gate of the third transistor Q3. The third resistor R3 is connected to an inverting input of the second operational amplifier U2 at one end and to an emitter of the fourth transistor T1 at the other end. The fourth resistor R4 is connected to a non-inverting input of the second operational amplifier U2 at one end and to one end of the fifth resistor R5 at the other end. The other end of the fifth resistor R5 is connected to an emitter of the fifth transistor T2. A source of the second transistor Q2 and a source of the third transistor Q3 are both connected to the regulating voltage Vreg. A drain of the second transistor Q2 is connected to the inverting input of the second operational amplifier U2. A drain of the third transistor Q3 is connected to the non-inverting input of the second operational amplifier U2. The band-gap reference voltage is output from a node between the non-inverting input of the second operational amplifier and the drain of the third transistor. A collector and a base of the fourth transistor T1 are both grounded. And a collector and a base of the fifth transistor T2 are both grounded.

A band-gap reference circuit comprising a LDO regulator and a reference circuit is provided in the present invention; the LDO regulator 10 can output a stable supply voltage such that the regulating voltage Vreg might be maintained constant, therefore, causing the band-gap reference voltage $V_{BG}$ output from the reference circuit to be maintained constant, hence improving the reliability of the band-gap reference voltage.

In summary, various configurations of the band-gap reference circuit have been detailed in the above embodiments. Of course, the present invention includes, but not limited to, the configurations disclosed above, and any and all modifications made to these configurations are considered to fall within the scope of the invention. Those skilled in the art can extend the inventive ideas in many ways.

The description presented above is merely that of some preferred embodiments of the present invention and does not limit the scope thereof in any sense. Any and all changes and modifications made by those of ordinary skill in the art based on the above teachings fall within the scope as defined in the appended claims.

What is claimed is:

1. A band-gap reference circuit, comprising a low dropout (LDO) regulator and a reference circuit, wherein the LDO regulator outputs a regulating voltage and provides the regulating voltage to the reference circuit, and wherein the regulating voltage is maintained constant and powers the reference circuit such that the reference circuit outputs a band-gap reference voltage, the LDO regulator powered by a supply voltage ranging from 1.6 V to 3.8 V and comprising a first operational amplifier, a first transistor and a voltage feedback circuit, wherein: the first transistor has a source coupled to the supply voltage and a drain coupled to the regulating voltage; the first operational amplifier outputs a first gate control voltage to switch on or switch off the first transistor; the voltage feedback circuit provides a feedback voltage which is positively correlated with the first gate control voltage to the first operational amplifier; and the first transistor is implemented as a P-channel field-effect transistor;

the reference circuit comprising a second transistor, a third transistor and a second operational amplifier with each of the second and third transistors being implemented as a P-channel field-effect transistor, wherein a source of the second transistor and a source of the third transistor are connected to the drain of the first transistor; a gate of the second transistor and a gate of the third transistor are connected to each other and further connected to an output of the second operational amplifier; an inverting input of the second operational amplifier is connected to a drain of the second transistor; a non-inverting input of the second operational amplifier is connected to each of a drain of the third transistor and an inverting input of the first operational amplifier; and the band-gap reference voltage is output from a node between the non-inverting input of the second operational amplifier and the drain of the third transistor and is applied to the inverting input of the first operational amplifier.

2. The band-gap reference circuit of claim 1, wherein the regulating voltage is 1.6 V and the band-gap reference voltage is 1.2 V.

3. The band-gap reference circuit of claim 1, wherein the feedback voltage is applied to a non-inverting input of the first operational amplifier, wherein a gate of the first transistor is connected to an output of the first operational amplifier, a source of the first transistor is coupled to the supply voltage, and a drain of the first transistor is connected to the voltage feedback circuit and coupled to the regulating voltage, and wherein the voltage feedback circuit comprises a first resistor and a second resistor, the first resistor connected to the drain of the first transistor at one end and to the non-inverting input of the first operational amplifier at the other end, the second resistor grounded at one end and connected to the non-inverting input of the first operational amplifier at the other end.

4. The band-gap reference circuit of claim 1, wherein the reference circuit further comprises a fourth transistor and a fifth transistor with each of the fourth and fifth transistors being implemented as a PNP triode, and wherein an emitter of the fourth transistor is coupled to the inverting input of the second operational amplifier, an emitter of the fifth transistor is coupled to the non-inverting input of the second operational amplifier, a collector and a base of the fourth transistor are both grounded, and a collector and a base of the fifth transistor are both grounded.

5. The band-gap reference circuit of claim 4, wherein the reference circuit further comprises a third resistor, a fourth resistor and a fifth resistor, and wherein the third resistor is connected to the inverting input of the second operational amplifier at one end and the third resistor is connected to the emitter of the fourth transistor at an other end; the fourth resistor is connected to the non-inverting input of the second operational amplifier at one end and the fourth resistor is connected to one end of the fifth resistor at the other end; and the fifth resistor is connected to the emitter of the fifth transistor at the other end.

6. The band-gap reference circuit of claim 4, wherein the non-inverting and inverting inputs of the second operational amplifier are equal in level.

7. A band-gap reference circuit, comprising a first operational amplifier, a second operational amplifier, first to third transistors and a voltage feedback circuit, wherein:

each of the first to third transistors is implemented as a P-channel field-effect transistor;

a source of the first transistor is coupled to a supply voltage and a drain of the first transistor is connected to the voltage feedback circuit and coupled to a regulating voltage;

the first operational amplifier outputs a first gate control voltage to a gate of the first transistor to switch on or switch off the first transistor;

the voltage feedback circuit provides a feedback voltage which is positively correlated with the first gate control voltage to a non-inverting input of the first operational amplifier;

a source of the second transistor and a source of the third transistor are connected to the drain of the first transistor to receive the regulating voltage;

a gate of the second transistor and a gate of the third transistor are connected to each other and further connected to an output of the second operational amplifier;

a drain of the second transistor is connected to an inverting input of the second operational amplifier, and a drain of the third transistor is connected to each of a non-inverting input of the second operational amplifier and an inverting input of the first operational amplifier; and a band-gap reference voltage is output from a node between the drain of the third transistor and the non-inverting input of the second operational amplifier, the band-gap reference voltage being applied to the inverting input of the first operational amplifier.

8. The band-gap reference circuit of claim 7, wherein the voltage feedback circuit comprises a first resistor and a second resistor, the first resistor connected to the drain of the first transistor at one end and to the non-inverting input of the first operational amplifier at an other end, the second resistor grounded at one end and connected to the non-inverting input of the first operational amplifier at the other end.

9. The band-gap reference circuit of claim 7, further comprising a fourth transistor and a fifth transistor with each of the fourth and fifth transistors being implemented as a PNP triode, and wherein an emitter of the fourth transistor is coupled to the inverting input of the second operational amplifier, an emitter of the fifth transistor is coupled to the non-inverting input of the second operational amplifier, a collector and a base of the fourth transistor are both grounded, and a collector and a base of the fifth transistor are both grounded.

10. The band-gap reference circuit of claim 9, further comprising a third resistor, a fourth resistor and a fifth resistor, and wherein the third resistor is connected to the inverting input of the second operational amplifier at one end and the third resistor is connected to the emitter of the fourth transistor at the other end; the fourth resistor is connected to the non-inverting input of the second operational amplifier at one end and the fourth resistor is connected to one end of the fifth resistor at the other end; and the fifth resistor is connected to the emitter of the fifth transistor at the other end; the band-gap reference circuit is powered by a supply voltage ranging from 1.6 V to 3.8 V; the regulating voltage is 1.6 V and the band-gap reference voltage is 1.2 V.

* * * * *